US010035170B2

(12) United States Patent
Denny

(10) Patent No.: US 10,035,170 B2
(45) Date of Patent: Jul. 31, 2018

(54) ROLL-UP GROUT BAG

(71) Applicant: Sean P Denny, Springfield, IL (US)

(72) Inventor: Sean P Denny, Springfield, IL (US)

( * ) Notice: Subject to any disclaimer, the term of this patent is extended or adjusted under 35 U.S.C. 154(b) by 0 days.

(21) Appl. No.: 15/043,863

(22) Filed: Feb. 15, 2016

(65) Prior Publication Data

US 2017/0232467 A1 Aug. 17, 2017

(51) Int. Cl.

| | |
|---|---|
| ***B65D 35/28*** | (2006.01) |
| ***B05C 17/005*** | (2006.01) |
| ***B65D 83/00*** | (2006.01) |
| ***B65D 35/32*** | (2006.01) |

(52) U.S. Cl.
CPC ..... *B05C 17/00583* (2013.01); *B65D 35/32* (2013.01); *B65D 83/0066* (2013.01)

(58) Field of Classification Search
CPC ..... B56D 35/34; B56D 35/32; B56D 35/285; B65D 83/006; B05C 17/00583
USPC ..... 222/98–104
See application file for complete search history.

(56) References Cited

U.S. PATENT DOCUMENTS

| | | | | | |
|---|---|---|---|---|---|
| 2,545,773 | A | | 2/1947 | Gonzalez | |
| 3,006,508 | A | | 9/1958 | Preidel | |
| 2,903,162 | A | | 9/1959 | Regan | |
| 3,291,344 | A | | 12/1966 | Meyer | |
| 3,428,331 | A | * | 2/1969 | Morgan | B60P 7/083 410/100 |
| 4,212,336 | A | * | 7/1980 | Smith | B25B 15/00 81/177.2 |
| 4,576,314 | A | * | 3/1986 | Elias | B65D 35/32 222/103 |
| 4,627,551 | A | * | 12/1986 | Kopp | B65D 35/285 222/1 |
| 4,664,293 | A | * | 5/1987 | Sheppard | B65D 35/32 222/99 |
| 5,178,301 | A | * | 1/1993 | McGanty | B65D 35/32 222/99 |
| 5,222,630 | A | | 6/1993 | Burtis | |
| 5,421,486 | A | * | 6/1995 | Simmons | B65D 35/34 222/100 |
| 6,520,379 | B1 | * | 2/2003 | Campbell | B65D 35/32 222/99 |
| 6,619,506 | B2 | | 9/2003 | Famiglietti | |
| 2008/0160055 | A1 | * | 7/2008 | Balmelli | A61K 8/26 424/401 |

FOREIGN PATENT DOCUMENTS

| | | | |
|---|---|---|---|
| AT | 503920 B1 | * | 2/2008 |
| DE | 9302869 U1 | * | 6/1993 |
| GB | 327336 | * | 4/1930 |
| GB | 846785 | * | 8/1960 |

* cited by examiner

*Primary Examiner* — Lien Ngo
(74) *Attorney, Agent, or Firm* — Erickson Kernell IP, LLC; John C. McMahon

(57) ABSTRACT

A roll-up grout bag apparatus includes a dowel with a slot formed therethrough from an open end to a closed end thereof. A lever is engaged with the dowel at the closed end to facilitate rolling the dowel about an axis thereof. The slot receives a filling end of a grout bag and is rolled onto the dowel using the lever to urge grout within the bag to be dispensed from an opening at a narrow dispensing end of the bag. The apparatus may include a ratchet mechanism to engage the lever with the dowel.

14 Claims, 1 Drawing Sheet

Fig.1.
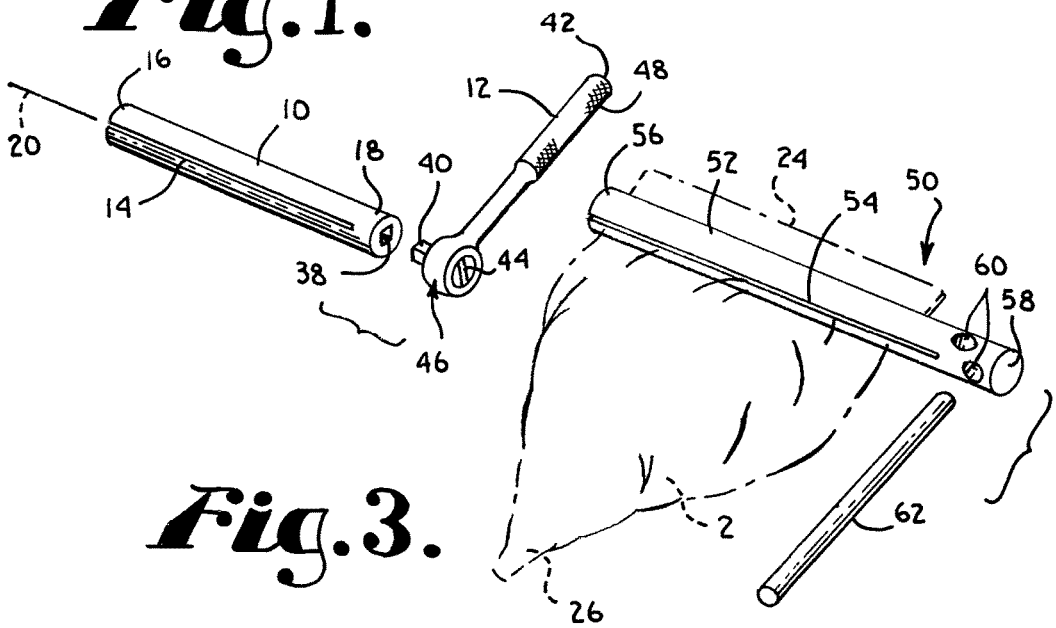
Fig.3.
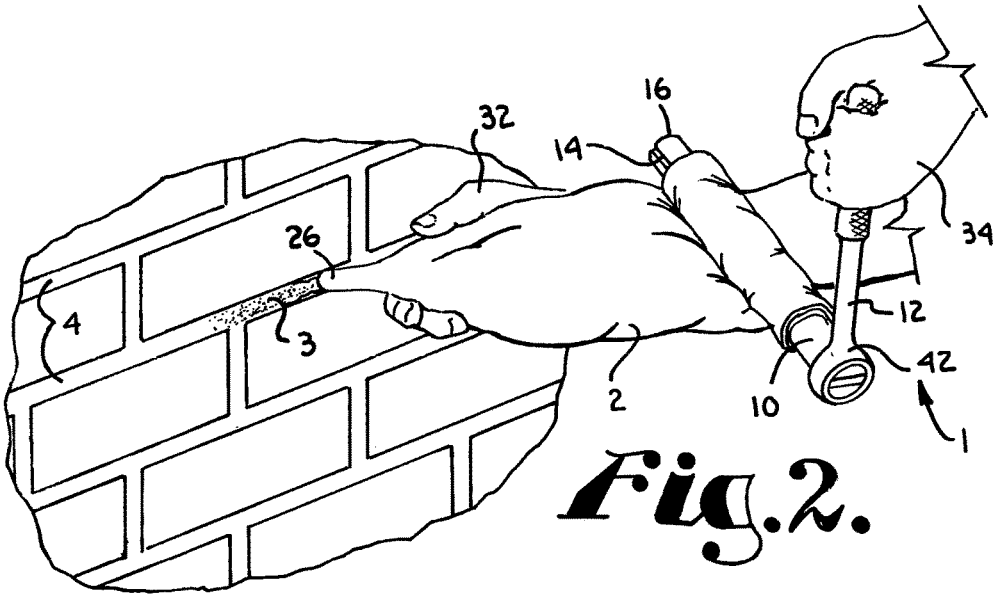
Fig.2.

ROLL-UP GROUT BAG

BACKGROUND OF THE INVENTION

The present invention is broadly concerned with improvements in equipment for certain kinds of masonry work and, more particularly, to apparatus for efficiently applying grout or cement to a pattern of construction elements such as tiles, bricks, blocks, elements of rock walls, and the like.

Grout is a fluid form of concrete or cement which is typically used to fill gaps. It may be used in construction to embed rebars in masonry walls, connect sections of pre-cast concrete, fill voids, and seal joints such as those between tiles. Grout is generally a mixture of water, cement, sand, often color tint, and sometimes fine gravel if it is being used to fill large spaces such as the cores of concrete blocks. Unlike other structural pastes such as plaster or joint compound, correctly mixed and applied grout forms a waterproof seal. Although grout and mortar are somewhat similar in that both are applied as a thick emulsion and harden over time, grout is distinguished from its close relative mortar by its viscosity. Grout is typically thinner than mortar so that it flows readily into gaps, while mortar is thick enough to support not only its own weight, but also that of masonry placed on top of it.

Grout or cement may be applied using typical types of masonry hand tools, such as variously shaped trowels, floats, and the like. Typically, a quantity of grout is placed near joints or seams to be grouted and the grout is manipulated into the seams using the hand tools. Afterwards, the grouted array is "wiped" or washed with wet sponges to clean up excess grout.

More recently, grout bags have been devised for applying grout. Grout bags typically are conical or triangular in shape, having an open wide end and a narrow end with a dispensing aperture, which may be reinforced by a hollow tip. Grout bags are often made of a polymer film, such as polyvinyl chloride or the like. The film may be reinforced by a fabric laminated therewith, particularly if the bag is a reusable type. The tip may be permanently attached or may be removable and replaceable. Grout bags are available from construction equipment suppliers, home improvement stores, and the like Exemplary types of grout bags are disclosed in U.S. Pat. Nos. 5,222,630 and 6,619,506, which are incorporated herein by reference.

A mixture of grout is placed in the bag through the wide end, which is then closed. The bag is compressed manually to extrude a bead of grout out of the dispensing aperture, for example, for application between tiles. The contents may be squeezed or twisted manually to expel the grout from the tip. Alternatively, the wide end of the bag may be rolled to compress the contents therein. Grout bag arrangements are somewhat similar to so-called piping bags which are used in baking to form various shapes and lines of icing for decorating cakes, pastries, and the like.

While grout is less viscous than materials like mortar, it is viscous enough that considerable labor is required to apply grout to joints of a large area of tiles or the like. When the tile pattern to be grouted is on a vertical wall, squeezing and twisting of the grout bag can be particularly awkward. Thus, there is a need for apparatus for facilitating the use of grout bags in certain types of construction activities and which requires less clean-up effort than conventional methods of applying grout and cement.

SUMMARY OF THE INVENTION

The present invention provides embodiments of an improved apparatus for applying grout, for example, to tiles, bricks, or the like. Use of the term "grout" herein is intended to encompass similar flowable materials, such as cement and the like.

An embodiment of the grout applying apparatus includes an elongated dowel engaged with a wide filling or rolling end of a material bag containing a viscous flowable material to urge the material from a narrow dispensing end of the bag and a lever engaged with the dowel to facilitate rolling the material bag onto the dowel. The dowel may be cylindrical in shape and have a slot formed along a substantial portion of the length of the dowel to receive the wide end of the bag. The dowel may have a radial bore formed in a closed end of the dowel to receive an elongated lever to roll the bag onto the dowel. The bore may have a metal socket inserted therein to prevent wear of the bore by repeated insertion of the lever therein.

In an embodiment of the grout applying apparatus, a ratcheting mechanism is engaged between the lever and the dowel. The ratcheting mechanism allows the dowel to be rolled with a sort of reciprocating motion in which the lever is maintained in a desirable position relative to the bag. The dowel may be provided with a socket formed into the closed end thereof which is adapted to receive the drive lug of a ratcheted socket wrench. The socket may be lined with a metal liner to receive the drive lug. The socket wrench may be a conventional type of socket wrench.

Various objects and advantages of the present invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 1 is an exploded perspective view of an embodiment of a roll-up grout bag apparatus according to the present invention.

FIG. 2 is a fragmentary perspective view showing use of the roll-up grout bag apparatus of the present invention.

FIG. 3 is an exploded perspective view of an alternative embodiment of a roll-up grout bag apparatus according to the present invention, with a grout bag shown in phantom.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates an embodiment of a roll-up grout bag apparatus according to the present invention. The apparatus 1 is used in cooperation with a grout bag 2 to facilitate the application of a bead of grout 3, or similar type of material, to joints or seams 4 between construction elements 5, such as tiles 6, bricks, blocks, elements of rock walls, and the like.

In an illustrated embodiment, the grout bag or extrusion apparatus 1 includes an elongated dowel 10 and a lever member 12. The illustrated dowel or split dowel 10 is cylindrical in shape and has an elongated slit or slot 14 formed from an open end 16 of the dowel to near a closed end 18 of the dowel 10. The slot 14 is preferably formed diametrically through the dowel 10, that is through a longitudinal or cylindrical axis 20 (FIG. 1) of the dowel 10, so that the remaining portions of the dowel 10 have equal strength. The lever 12 engages the dowel 10 in such a manner as to facilitate rotation of the dowel 10 about its axis 20.

The dowel 10 may formed from any suitable material having the necessary strength to function as desired. The dowel 10 may be formed from a type of wood, a polymer, a metal, or a combination of such materials. The dowel 10 may formed as a unitary or monolithic type of construction by conventional processes or it may be assembled from preformed components.

The illustrated grout bag 2 is slender and conical in shape and has a wide filling end 24 (FIG. 3) and a narrow dispensing end 26 (FIG. 2) opposite from the wide end 24. The narrow end 26 may have a reinforced conical tip (not shown) to maintain a desired size and shape of the bead of grout 3. The tip of the bag 2 may be provided in various sizes depending on the type of material 3 being applied and the desired size of the bead of material. The bag 2 is formed of a flexible liquid sealing type of material, such as a polymer film which may be laminated with a fabric for reinforcement. The grout bag 2 may be a disposable item or it may, alternatively, be reusable, depending on its construction. The bag 2 is filled with a quantity of grout 3 through the filling end 24, and the grout 3 is extruded or dispensed from the dispensing end 26 by applying external pressure to the bag 2. The grout bag 2 may be a conventional type of grout bag, as are commercially available.

The filling end 24 of the grout bag 2 is inserted through the slot 14 of the dowel 10, and the lever 12 is engaged to roll the bag onto the dowel 10 to pressurize the grout 3 within the bag to thereby force the grout 3 out the dispensing end 26 of the bag 2. As shown in FIG. 2, a right-handed masonry worker or tile setter can support the bag 2 and dowel 10 with the inside of the right forearm 30 near the wrist and support the dispensing end 26 with the hand 32 of the same arm. The worker can then operate the lever 12 to roll the grout bag 2 using the free hand 34, such as the left hand. For a left-handed worker, the operations are swapped right to left.

In the embodiment of the apparatus 1 illustrated in FIG. 1, the dowel 10 is provided with a socket 38 at the closed end 18 thereof which is sized and shaped to receive a drive lug or "drive" 40 of a ratcheted or ratcheting socket wrench mechanism or wrench 42, which includes the lever 12 for rotating the dowel 10 about its axis 20. It is foreseen that the socket 38 may incorporate a metal socket liner (not shown) to prevent wear of the material forming the closed end 18 of the dowel 10. The wrench 42 may be a conventional type of reversible ratchet socket wrench which rotates with the drive lug 40 in a first angular direction and slips in the opposite direction. The wrench 42 may include a direction switch 44 which can be operated to reverse the directions in which the wrench 42 catches the lug 40 and in which it slips. The drive lug 40 and socket 38 may be of an industry standard size, such as a ⅜ inch (0.375 inch or about 9.5 mm) square shape. The ratcheting socket wrench 42 forms a ratchet mechanism 46 which engages the lever 12 with the dowel 10 to facilitate rotation of the dowel 10 using short reciprocating motions rather than a continuous angular motion to rotate the dowel 10. The lever 12 of the illustrated wrench 42 has a knurled or roughened surface 48 to facilitate gripping the lever 12.

FIG. 3 illustrates a modified embodiment 50 of the grout bag roll-up apparatus according to the present invention. The apparatus 50 includes an elongated cylindrical dowel 52 with a diametric slot 54 extending from an open end 56 of the dowel 52 to an opposite closed end 58 thereof. At the closed end 58, a plurality of circumferentially spaced radial bores 60 are formed into the dowel 52 to receive a lever 62 therein. The slot 54 is adapted to receive the wide filling end 24 of the bag 2 to enable the bag to be rolled onto the dowel 52 to urge grout 3 from the narrow dispensing end 26 thereof. The lever 62 is received into a convenient one of the bores 60 to facilitate rotating the dowel 52 about a cylindrical axis, similar to the axis 20. The plurality of bores 60 enables the masonry worker to remove the lever from one bore 60 and replace it in a more convenient bore as the dowel 52 is rotated. In other respects, the apparatus 50 functions in a manner substantially similar to the apparatus 1.

It is to be understood that while certain forms of the present invention have been described and illustrated herein, it is not to be limited to the specific forms or arrangement of parts described and shown.

What is claimed and desired to be secured by Letters Patent is:

1. An extrusion apparatus for use with a material bag adapted to contain a viscous flowable material and having a narrow dispensing end and a wide filling end opposite the dispensing end to urge the viscous flowable material from the dispensing end, the apparatus comprising:

(a) a material bag that is hand held and adapted to be fully supported by a user during use;

(b) an elongated dowel engaged with a wide filling end of the material bag containing a viscous flowable material to urge such a material from a dispensing end of such a bag when the dowel is rolled with the bag;

(c) a ratcheting socket wrench engaged with the dowel to operably rotate the dowel when operated to facilitate rolling such a material bag onto the dowel.

2. An apparatus as set forth in claim 1 and including:

(a) an elongated slot formed in the dowel to receive a wide end of material bag to enable rolling such a bag onto the dowel.

3. An apparatus as set forth in claim 1 and including:

(a) a radial bore formed in the dowel to receive the lever to facilitate rolling a material bag onto the dowel.

4. An apparatus as set forth in claim 1 wherein:

(a) the dowel has opposite ends;

(b) an end of the dowel has a socket therein which is adapted to receive a drive lug of the socket wrench; and (c) the socket wrench having a drive lug thereof received in the socket of the dowel to facilitate rolling a material bag onto the dowel.

5. An apparatus as set forth in claim 1 in combination with:

(a) the material bag is constructed of a soft and pliable material and is adapted to contain a viscous flowable material and having a narrow dispensing end and a wide filling end opposite the dispensing end.

6. A method of applying a viscous flowable grout using the apparatus set forth in claim 1 comprising the steps of:

(a) placing a quantity of a viscous flowable grout into the material bag through a wide filling end thereof;

(b) thereafter the user holding the bag end operates the wrench and rolling a wide filling end of the material bag with the dowel; and (c) continuing to roll the bag onto the dowel through to urge the material out of a narrow dispensing end of the material bag.

7. A masonry composition dispensing apparatus for selectively dispensing a narrow flowable bead of the masonry composition and comprising:

(a) a grout bag adapted to contain the masonry composition and having a narrow dispensing end and a wide filling end opposite the dispensing end; the grout bag being adapted to be held in the hands of a user and entirely supported by the user during operation;

(b) an elongated, substantially cylindrical dowel engaged with the bag at the filling end to enable rolling the bag from the filling end to urge a grout from the dispensing end; and (c) a ratchetable socket wrench radially engaged with the dowel to facilitate rolling the bag onto the dowel.

8. An apparatus as set forth in claim 7 and including:

(a) an elongated slot formed in the dowel to receive the wide end of the grout bag to enable rolling the bag onto the dowel.

9. An apparatus as set forth in claim 7 wherein:

(a) the dowel has opposite ends; the ratchetable socket wrench has a drive lug;

(b) an end of the dowel has a socket formed therein end which is adapted to receive the drive lug of the ratchetable socket wrench; and (c) the ratchetable socket wrench drive lug is received in the socket of the dowel to facilitate rolling the bag onto the dowel.

10. A flowable grout dispensing apparatus for selectively dispensing a narrow bead of a masonry composition and comprising:

(a) a grout bag adapted to contain the grout and having a narrow dispensing end and a wide filling end opposite the dispensing end; the grout bag being sized and shaped to be held in the hands of a user and being fully supported by the user;

(b) an elongated, substantially cylindrical dowel engaged with the bag at the filling end to enable rolling the bag from the filling end to urge a grout from the dispensing end;

(c) an elongated slot formed in the dowel to receive the wide end of the grout bag to enable rolling the bag onto the dowel; and (d) a ratchetable socket wrench radially engaged with the dowel and being operable to facilitate rolling the bag onto the dowel.

11. An apparatus as set forth in claim 10 and including:

(a) a radial bore formed in the dowel to receive the wrench to facilitate rolling the bag onto the dowel.

12. An apparatus as set forth in claim 10 wherein:

(a) the dowel has opposite ends;

(b) an end of the dowel has a socket formed therein end which is adapted to receive a drive lug of the socket wrench; and (c) the ratchetable socket wrench having a drive lug thereof received in the socket of the dowel to facilitate rolling the bag onto the dowel when operated.

13. An apparatus as set forth in claim 12 including:

(a) a metal receiver inset in the dowel socket and having an internal cross section sized and shaped to receive the drive lug of the socket wrench.

14. A method of applying a narrow bead of a viscous flowable grout comprising the steps of:

(a) providing a hand held and operator supported material bag adapted to contain the viscous flowable grout and having a narrow dispensing end and a wide filling end opposite the dispensing end;

(b) engaging the wide end of the bag with a dowel to enable rolling the bag from the wide end onto the dowel;

(c) engaging a ratchetable socket wrench with the dowel to facilitate rolling the bag onto the dowel;

(d) placing the dispensing end of the bag at a location where a viscous flowable material is to be applied; and (c) rolling the bag onto the dowel using the ratchetable socket wrench so as to urge a flowable material from within the bag through the dispensing end thereof.

* * * * *